United States Patent [19]

Watson et al.

[11] Patent Number: 5,028,048

[45] Date of Patent: Jul. 2, 1991

[54] GAME CARRYING AND PLAYING APPARATUS

[76] Inventors: Jayme S. Watson, 1513 Gabaldon Drive, N.W., Space #3, Albuquerque, N. Mex. 87104; Kenneth E. DeWees, 2616 Sierra, N.E., Albuquerque, N. Mex. 87110

[21] Appl. No.: 602,360

[22] Filed: Oct. 23, 1990

[51] Int. Cl.[5] ..... A63F 3/06; B65D 85/20

[52] U.S. Cl. ..... 273/148 A; 273/309; 273/269; 206/579; 206/315.1; 190/110; 248/441.1

[58] Field of Search ..... 273/309, 269, 148 A, 273/287, 285; 248/444, 441.1, 450, 451, 452, 455, 460, 461; 206/315.1, 579, 45.18; 190/110

[56] References Cited

U.S. PATENT DOCUMENTS

| | | | |
|---|---|---|---|
| 3,773,154 | 11/1973 | Mitchell | 248/455 |
| 3,871,519 | 3/1975 | Groomes | 206/223 |
| 3,921,983 | 11/1975 | Taylor | 273/269 |
| 4,500,091 | 2/1985 | Rovsek | 273/269 |
| 4,618,151 | 10/1986 | Fadner et al. | 273/148 A |
| 4,630,830 | 12/1986 | Gadd | 273/240 |
| 4,646,804 | 3/1987 | Damiano | 150/112 |
| 4,761,008 | 8/1988 | Huggins | 273/148 R |
| 4,765,583 | 8/1988 | Tenner | 248/444 |
| 4,872,550 | 10/1989 | Stranges | 273/285 |
| 4,948,139 | 8/1990 | Heeszel | 273/148 A |

FOREIGN PATENT DOCUMENTS

| | | | |
|---|---|---|---|
| 1163871 | 6/1985 | U.S.S.R. | 273/260 |

*Primary Examiner*—Benjamin Layno
*Attorney, Agent, or Firm*—DeWitt M. Morgan

[57] ABSTRACT

A game carrying and playing device including a case having a top, bottom, front, back and sides. The top includes a surface for supporting one or more game cards. The sides are of trapezoidal shape so that, when the bottom is positioned on a horizontal surface, the top surface is inclined with respect to the horizontal. The device also includes a storable, compartmentalized tray or container, and structure on the back of the case for detachably supporting the tray adjacent to the top surface when the case is in the playing position.

5 Claims, 2 Drawing Sheets

GAME CARRYING AND PLAYING APPARATUS

BACKGROUND OF THE INVENTION

Over the past several years a number of United States patents have issued directed to various cases and holders for use in playing bingo.

U.S. Pat. No. 4,761,008 to P. D. Huggins discloses what is described as a bingo caddy useful for transporting and holding various bingo-playing paraphernalia. The caddy includes a compartmentalized container adapted to hold, for instance, metal bingo tokens, magnetic dabbers, ink markers, coins, paper money, and other personal items. The caddy has a detachable top. In use, the top is removed and set aside, and the caddy is supported on a horizontal surface at an acute angle to provide clear vision into the interior compartments as well as easy access thereto during bingo playing.

U.S. Pat. No. 3,871,519 to J. Groomes discloses a case adapted for the carrying and storage of bingo-playing equipment, such as chips, pencils, markers and an apron. The case consists of two separate semi-circular portions which are hinged at the base.

A bingo game box is disclosed in U.S. Pat. No. 4,500,091 to E. Rovsek. The apparatus disclosed in this reference includes a box having a cover adapted to store such items as markers, chips or tokens, as well as a clear flexible strip. In use, the flexible strip is designed to overlay a number of bingo cards on top of which various chips or tokens are placed. At the end of the game, the flexible strip can be raised up to allow the tokens to slide into the interior of the box.

Finally, U.S. Pat. No. 4,630,830 to H. E. Gadd discloses a bingo game card holder and U.S. Pat. No. 4,646,804 to M. Damiano discloses a handbag having a series of pockets for carrying a variety of bingo-playing apparatus.

Although not disclosed in any known prior reference, applicants are also aware of the use of boards, typically made of a piece of wood and typically hinged in the middle, which have wedge shaped supports on opposite ends for use in supporting a number of bingo-playing cards on a surface inclined to a horizontal surface such as a table.

The object of the present invention is to provide a carrying case suitable for: (1) carrying a variety of bingo, or other game-playing, paraphernalia when in its storage configuration; and (2) supporting such paraphernalia on the exterior of the case when the case is in its playing position. The case is so configured that in its playing position one surface thereof supports one or more game-playing sheets in a position inclined with respect to the horizontal.

SUMMARY OF THE INVENTION

A game carrying and playing device including a case having a top portion, bottom portion, and side portions which define an interior space. The top portion includes a top surface adapted to support one or more game cards. The bottom portion includes structure (most simply a flat surface) for contacting a flat, generally horizontal support surface, such as a table top. The side portions position the top surface at an angle inclined with respect to the horizontal surface when the contacting structure is in contact with this surface. The top portion is moveable with respect to the bottom portion to provide access to the interior space of the case. The apparatus also includes a compartmentalized container and structure, on the exterior of the case, for detachably supporting the container adjacent to the top surface. The container is configured to fit within the case when not supported adjacent to the top surface. In operation, the container is positioned adjacent to the top surface to permit quick and convenient access to such items as dabbers, pencils, and other personal items used in playing, for instance, bingo.

DESCRIPTION OF THE PREFERRED EMBODIMENT

Figure 1:
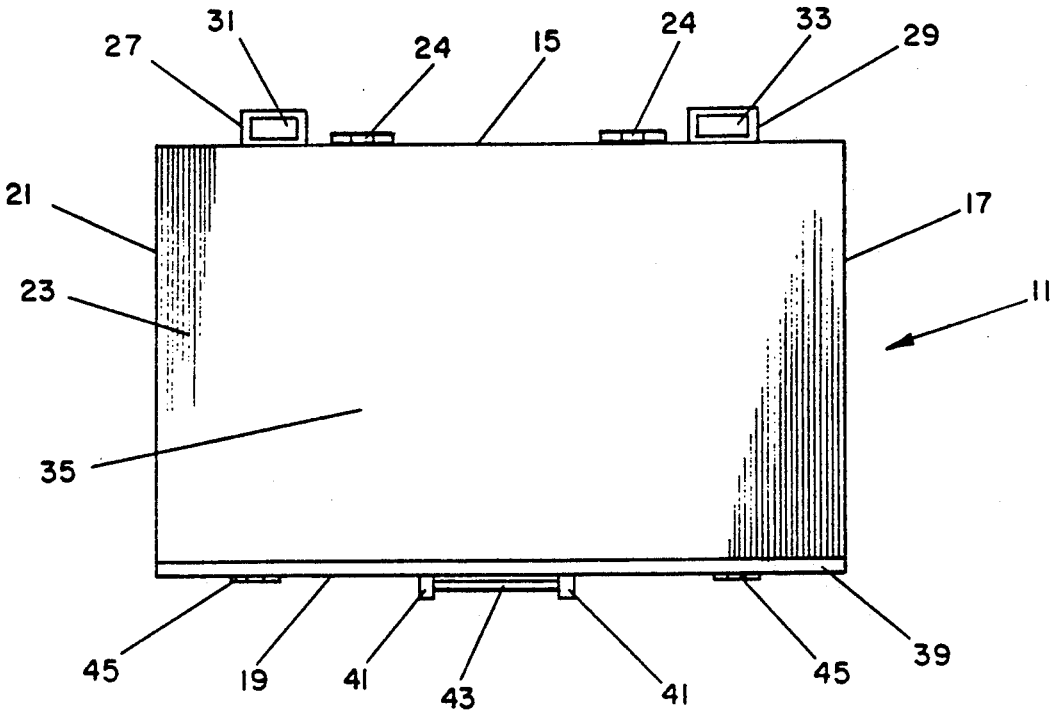
FIG. 1 is a top plane view of the case of the present invention.
Figure 2:
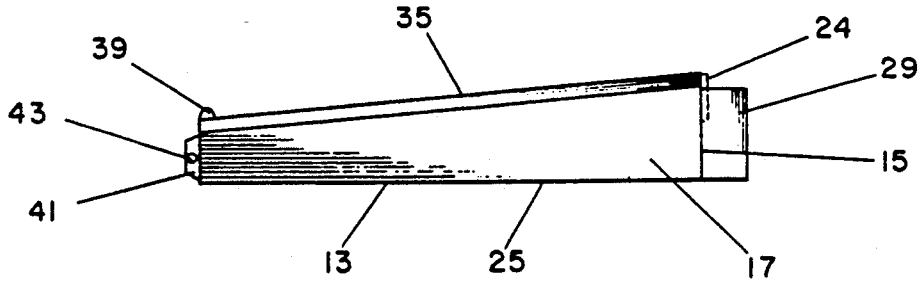
FIG. 2 is a side view of the case of FIG. 1.
Figure 3:
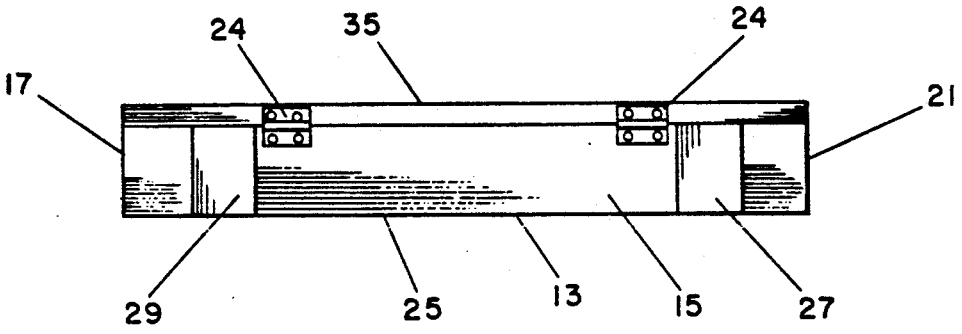
FIG. 3 is a back view of the case of FIG. 1.
Figure 4:
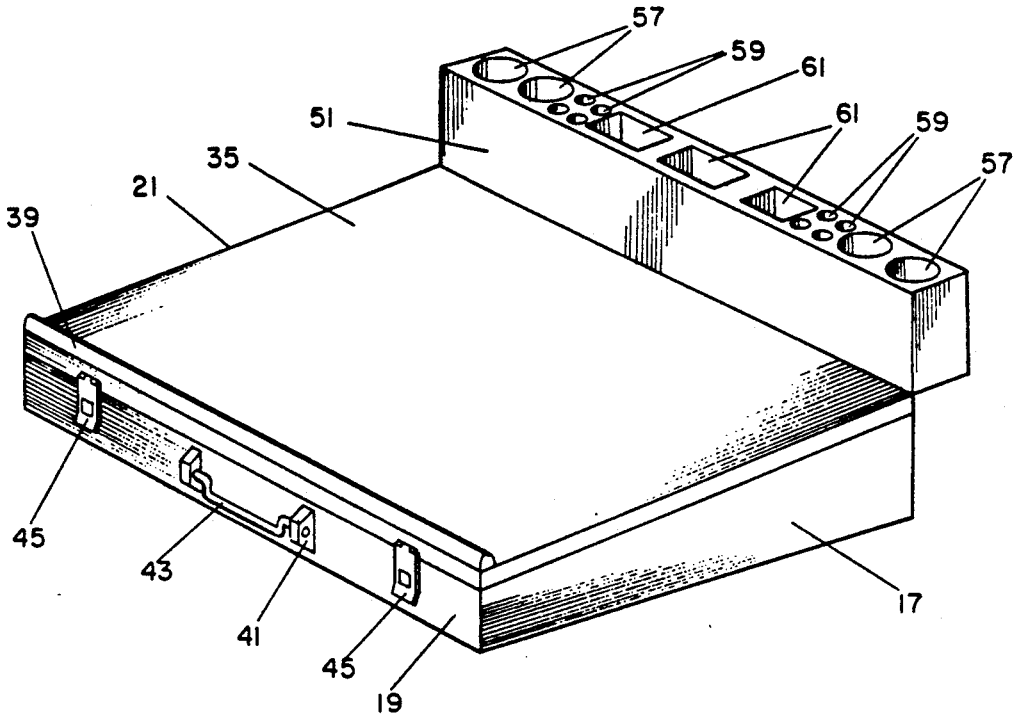
FIG. 4 is a perspective view of the case of FIG. 1, together with the accessory tray.

Case 11 includes a bottom portion 13, side portions 15, 17, 19 and 21 and top portion 23, which is connected to side portion 15 by hinges 24. Bottom portion 13 has, preferably, a flat surface 25 and is designed to rest on a flat, generally horizontal, surface, such as a table top. Side portion 15 includes two pin supports 27 and 29 having, respectively, pin receiving cavities 31 and 33. Side portions 17 and 21 are of trapezoidal configuration to position, when surface 25 is resting on a horizontal surface, surface 35 of top portion 23 in a plane inclined with respect to the horizontal, as illustrated in FIGS. 2 and 4. In addition to surface 35, top portion 23 includes a lip portion 39. In the position illustrated in FIGS. 2 and 4, surface 35 supports one or more game cards (not shown), such as bingo-playing cards. Lip 39 functions to prevent such cards from sliding off surface 35. Finally, side portion 19, includes a handle support 41 to which handle 43 is secured in any conventional fashion. Conventional clasps or latches 45 are used for holding top portion 23 in its closed position.

The preferred embodiment of case 11 is molded from any suitable plastic. However, as those skilled in the art will appreciate, case 11 can be made of any suitable synthetic or natural material (such as leather, metal or wood) depending on the personal preferences of the user and the price to be paid for the case.

Figure 5:
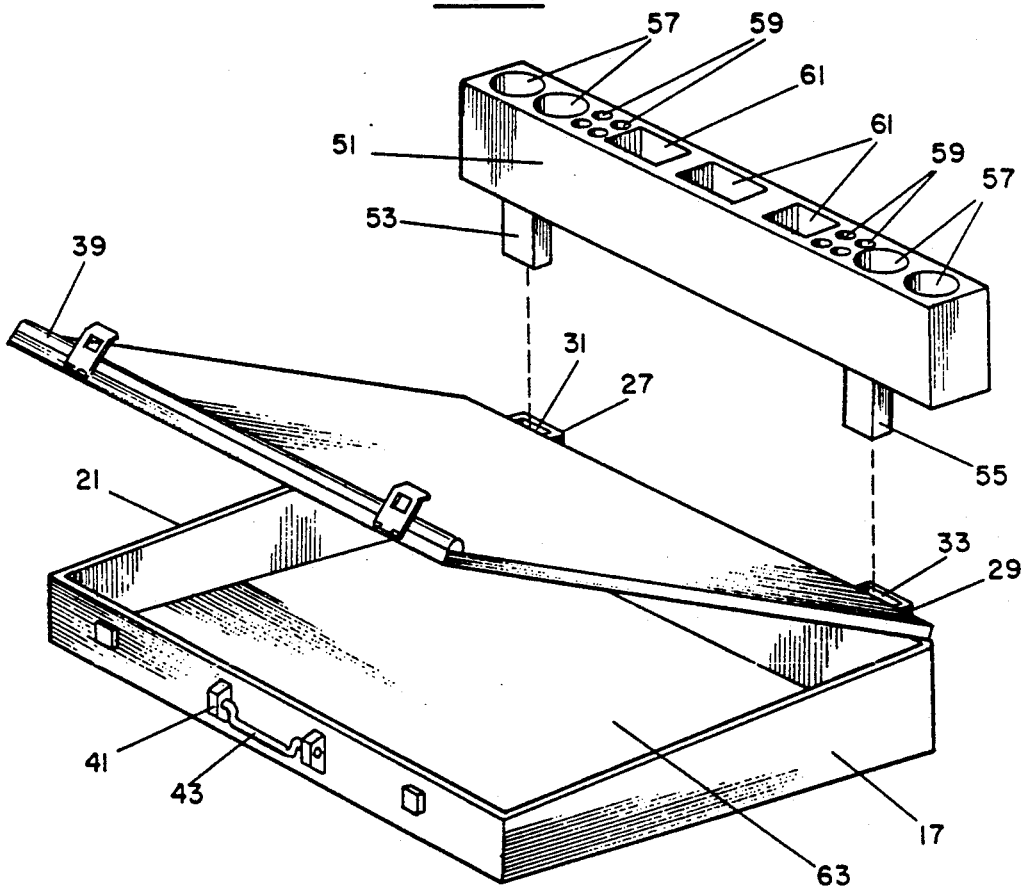
FIG. 5 is an exploded perspective view of the case and tray of FIG. 4.

Applicants' invention also includes, as best illustrated in FIGS. 4 and 5, an accessory tray 51, preferably molded out of any suitable plastic. Tray 51 includes pins 53 and 55 which are designed to be received in cavities 31 and 33. Tray 51 also includes a number of cavities of various shapes and sizes, such as indicated at 57, 59 and 61, to hold various game-playing accessories. In the case of bingo, cavities 57 could hold markers; cavities 59, pens or pencils; cavities 61, tokens or personal items. When not in use, tray 51 is positioned within cavity 63 of case 11. When in use, pins 53 and 55 are received in cavities 31 and 33 to position tray 51 relative to surface 35 in the manner illustrated in FIG. 4, to permit easy and convenient user access.

The above-described apparatus has the advantages of conveniently providing both a playing surface and a storage compartment in one device; inclining the playing surface relative to the horizontal to reduce glare on the game playing cards, permitting the user to quickly and conveniently organize game playing paraphernalia and other items; and utilizing less space for game (such as bingo) playing.

Whereas the drawings and accompanying description have shown and described the preferred embodiment of the present invention, it will be apparent to those skilled in the art that various changes may be made in the form of the invention without the affecting the scope thereof.

We claim:

1. A game carrying and playing apparatus, said apparatus comprising a top portion, bottom portion, and a side portion which define a case having an interior space, said top portion including a top surface adapted to support one or more game-playing cards or sheets, said bottom portion including means for contacting a support surface, said side portion positioning said top surface at an angle inclined with respect to said support surface when said contacting means are in contact with said support surface, said top portion being movable relative to said bottom portion to provide access to said interior space, said apparatus also including a compartmentalized container and means, on the exterior of said case, for detachably supporting said container adjacent to said top surface, said container being configured to fit within said case when not supported adjacent to said top surface.

2. The apparatus as set forth in claim 1, wherein said side portion includes a front, a back and two sides, said sides being of generally trapezoidal configuration.

3. The apparatus as set forth in claim 2, wherein said top portion is hinged to said side portion adjacent to said back.

4. The apparatus as set forth in claim 3, wherein said top portion includes a lip portion for holding said game-playing cards or sheets.

5. The apparatus as set forth in claim 2, wherein said means for supporting said compartmentalized container are positioned on said back, for supporting said container adjacent said top surface.

* * * * *